US007736154B2

(12) United States Patent
Hirata et al.

(10) Patent No.: US 7,736,154 B2
(45) Date of Patent: Jun. 15, 2010

(54) BOARD TO BOARD CONNECTOR

(75) Inventors: Toshihisa Hirata, Yamato (JP); Tetsuya Asakawa, Veldhoven (NL)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/886,822

(22) PCT Filed: Mar. 23, 2006

(86) PCT No.: PCT/US2006/010471

§ 371 (c)(1),
(2), (4) Date: Dec. 18, 2008

(87) PCT Pub. No.: WO2006/102452

PCT Pub. Date: Sep. 28, 2006

(65) Prior Publication Data

US 2009/0197440 A1 Aug. 6, 2009

(30) Foreign Application Priority Data

Mar. 23, 2005 (JP) ..... 2005-083517

(51) Int. Cl.
*H01R 12/00* (2006.01)

(52) U.S. Cl. ..... 439/74; 439/660

(58) Field of Classification Search ..... 439/660, 439/65, 74

See application file for complete search history.

(56) References Cited

U.S. PATENT DOCUMENTS

| | | | | |
|---|---|---|---|---|
| 6,692,266 | B2 * | 2/2004 | Hashiguchi et al. | 439/74 |
| 6,811,411 | B1 | 11/2004 | Hirata et al. | |
| 6,881,075 | B2 | 4/2005 | Huang et al. | |
| 2004/0053521 | A1 | 3/2004 | Kashio | |
| 2005/0009383 | A1 * | 1/2005 | Okura et al. | 439/74 |

FOREIGN PATENT DOCUMENTS

| | | |
|---|---|---|
| EP | 1 096 609 A1 | 5/2001 |
| EP | 1 519 451 A2 | 3/2005 |
| JP | H05-075978 | 10/1993 |
| JP | H06-215837 | 8/1994 |
| JP | 2004-303743 | 10/2004 |
| TW | M523181 | 9/1990 |

OTHER PUBLICATIONS

International Search Report for PCT/US06/010471.

* cited by examiner

*Primary Examiner*—Ross N Gushi
(74) *Attorney, Agent, or Firm*—Timothy M. Morella

(57) ABSTRACT

A board mounted connector for a board to board connector system is disclosed which can be smaller, provide a more robust connection to a conductive circuit on a printed circuit board while allowing for a high degree of circuit design freedom on the board circuit due to the terminal insertion from the mating side of the housing where the terminals are generally above a bottom portion (33) of the non-conductive housing (31) adjacent the board. The housing (31) is provided with fitting holes (37) extending from an end surface (32*d*) on the side which mates with the male housing (21). The female terminals (35) have anchor portions (36) to be fitted into the fitting holes (37) of the female housing (31) and contact portions (35*b*) to engage terminals in a mating connector. Forward end portions (36*a*) of the anchor portions (36) are soldered to a circuit terminal of the board (3). Cut out portions (39) in the rectangular frame portion (32) allow for the solder joint between the end portion (36*a*) and the conductive circuit (38) to be inspected.

15 Claims, 3 Drawing Sheets

BOARD TO BOARD CONNECTOR

BACKGROUND OF THE INVENTION

The present invention relates to a board mounted connector for connecting printed circuit boards to each other.

Existing board to board connecting systems include a male, or plug connector, to be soldered to one board and a female, or receptacle connector, to be soldered to another board. The male and female connectors are designed to engage and mate with one another. The plug connector and the receptacle connector are respectively provided with plug terminals and receptacle terminals that are to be soldered to conductive circuits on the boards. When the mating plug and receptacle are mated together, the plug and receptacle terminals are in electrical engagement with each other thereby electrically connecting the conductive circuits from one circuit board to the other circuit board.

Various types of board to board connectors have been used in the past. One such board connector has receptacle terminals with contact portions which electrically engage plug terminals in a mating plug connector, anchor portions for holding the receptacle terminals to a receptacle housing, and solder tail portions for soldering the receptacle terminals to a conductive circuit on a board.

In this board to board connector, the contact portions and the solder tail portions are spaced apart from one another since the solder tail portions extend from the anchor portions beyond the sides of the connector housing. The use of this connector requires a larger footprint on the printed circuit board. Also, because the solder tail portion extends from a flexible elongated arm located on the exterior of the connector, the strength of the solder joint is diminished. Furthermore, because of the long length of the solder tail arm, the signal has to travel a longer distance before it electrically communicates with the circuit on the circuit board. This extra length can be a factor in timing with high speed signals. Finally, such a connector has only one point of electrical and mechanical engagement with the printed circuit board which can result in a weak mechanical and electrical connection.

All of these characteristics are important for a connector with terminals which are inserted into a mating side of the connector housing opposite the side adjacent the printed circuit board. It is important that a bottom portion of the housing remains to prevent any short circuit between the terminals and the conductive circuits traveling under the housing after the terminals are inserted into the mating side of the connector. Providing this bottom housing portion will allow for more freedom of circuit designs on the printed circuit board.

SUMMARY OF THE INVENTION

According to one aspect of the present invention, a connector that is mounted to a first printed circuit board is designed to mate with a connector mounted to a second printed circuit board so that conductive traces on both boards can be electrically connected to each other. The connector includes a non-conductive housing having a rectangular frame portion with a fitting hole in portions of the frame portion extending from the mating surface of the housing opposite the board mounting surface and a bottom portion located adjacent to the printed circuit board. A plurality of terminals are held in the housing. Each of the terminals have a support portion, a contact portion to be brought into electrical contact with the male terminal, a bridging portion provided between the support portion and the contact portion, and an anchor portion extending from the support portion and fitted into the housing fitting hole. A bottom portion of the housing is located between the printed circuit board and the bridging portion of the terminal. A forward end portion of the anchor portion protrudes from the housing through the fitting hole for a distance so that the end can be soldered to a circuit on the circuit board.

According to another aspect of the invention, cut out portions are formed in the bottom of the frame portions along the sides of the connector housing near the board so that the solder joint formed between the end of the anchor and the board can be observed from the side of the board.

According to still another aspect of the invention and as displayed in another embodiment of the present invention, a solder tail may extend from the support portion toward the printed circuit board so that the solder tail and the end of the anchor can both be soldered to a circuit on the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
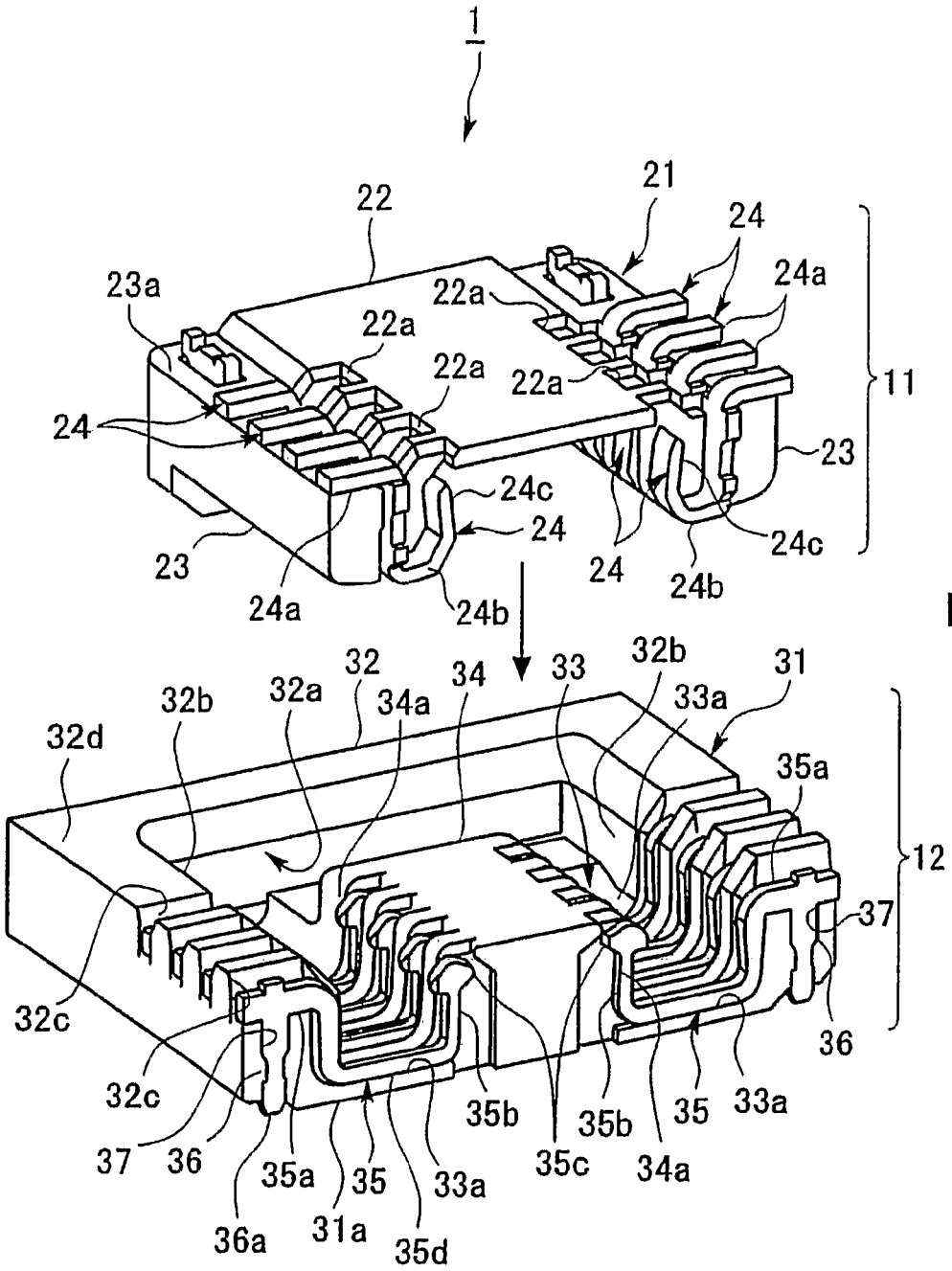
FIG. 1 is a perspective view of the plug connector and the receptacle connector of a board connecting connector according to an embodiment of the present invention as separated from each other.
Figure 2:
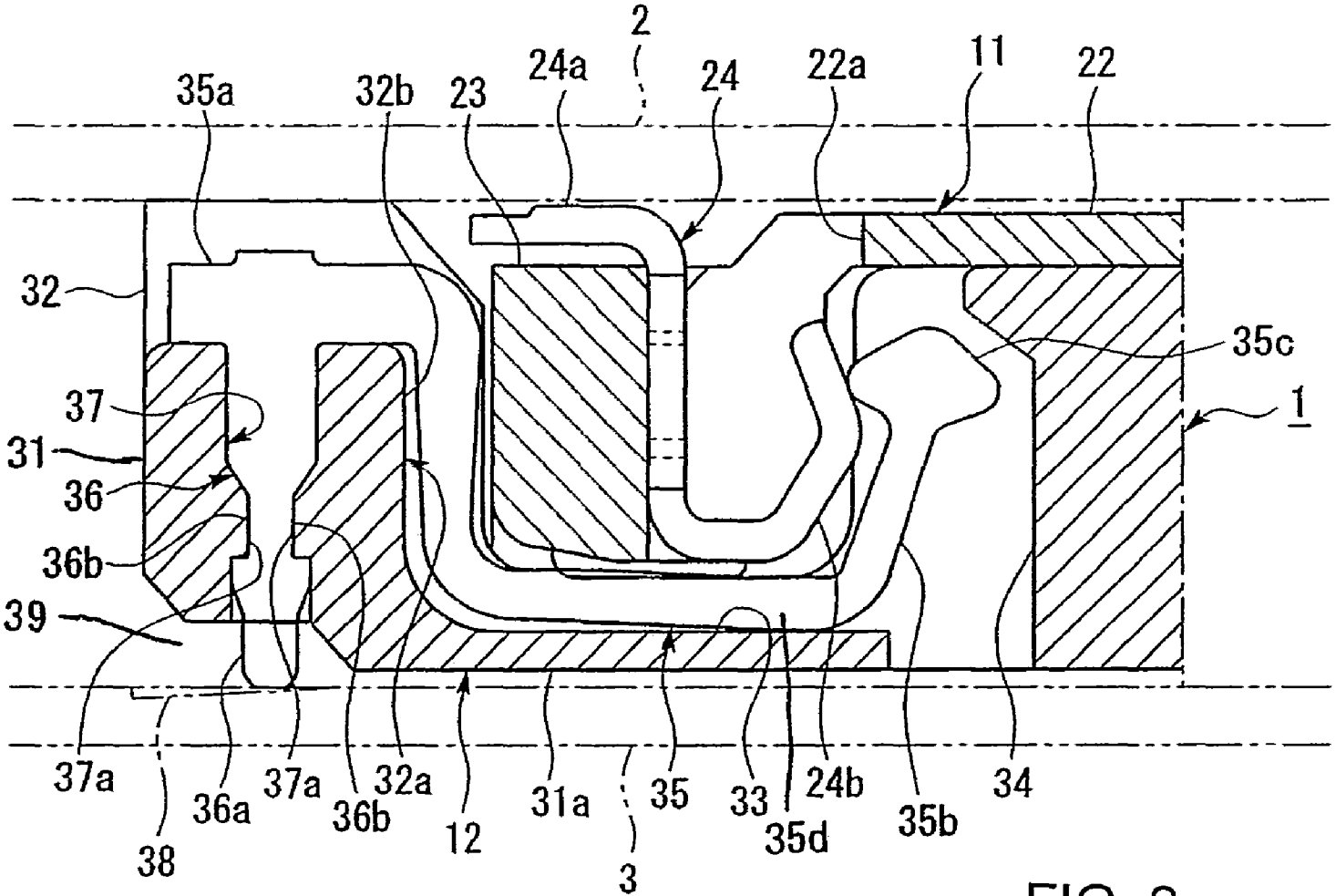
FIG. 2 is a partial sectional view of the plug and receptacle connector of FIG. 1 engaged with each other; and, FIG. 3 is a partial sectional view of a receptacle and plug connector mated together and illustrates another embodiment of the present invention.

In the following, a board connecting connector according to an embodiment of the present invention will be described with reference to the drawings. As shown in FIG. 1, a board to board connector system 1 is arranged between opposing boards 2, 3. (FIG. 2). The connector system 1 includes a plug connector 11, which is a male connector soldered to one board 2, and a receptacle connector 12, which is a female connector soldered to the other board 3. When the plug and receptacle connectors are joined the respective terminals are electrically connected to each other.

The plug connector 11 has a plug housing 21 made from a non-conductive material. The plug housing 21 has a bridging portion 22 formed as a rectangular flat plate, and relatively thick-walled fit-engagement protrusions 23 provided on either side of the bridging portion 22 and extending along the entire length of the bridging portion 22.

On the inner surface of the fit-engagement protrusion 23, on either side, there are arranged a plurality of plug terminals 24, which are male terminals to be soldered to the upper circuit board 2. The plug terminals 24 are arranged at equal intervals. The plug terminals 24 have support portions 24*a*, arranged and extending under the bottom surfaces 23*a* of the fit-engagement protrusions 23, and U-shaped contact portions 24*b*, extending downwards from one end of the support portions 24*a*. The plug terminals 24 are formed integrally by stamping them from conductive metal. The bridging portion 22 of the housing 21 includes openings 22*a* to allow for the insertion of the plug terminals 24 from above the bridging portion 22 into the space between the fit-engagement protrusions 23.

The receptacle connector 12 has a receptacle housing 31, which is a female housing made from a non-conductive material. The receptacle housing 31 has an outer rectangular or other shaped frame portion 32 into which the plug housing 21 of the plug connector 11 fits. A bottom portion 33 is provided on the bottom surface of the housing frame portion 32. A central protrusion 34 is provided along the center of the bottom portion 33 and protrudes into the interior of the outer frame portion 32. A fit-engagement recess 32*a* is formed on the inner side of the outer frame portion 32 and it surrounds the central protrusion 34 as shown in FIG. 1.

On the inner side of the outer frame portion 32 of the receptacle housing 31, there are arranged a plurality of receptacle terminals 35, which are also called female terminals. The receptacle terminals 35 are inserted into the receptacle housing 31 from the side of the frame portion 32 which mates with the plug connector (shown as the top in the figures). The receptacle terminals 35 extend from the mating side end surface 32*d* (the top surface in FIG. 1) of the receptacle housing 31 to side surfaces 34*a* of the central protrusion 34 by way of the inner side surface 32*b* of the frame portion 32 and the inner bottom surface 33*a* of the bottom portion 33.

As shown best in FIG. 2, the receptacle terminals 35 have support portions 35*a* arranged in horizontal grooves 32*c* provided along the top mating side end surface 32*d* of the frame portion 32. L-shaped bridging portions 35*d* extend downward from one end of the support portions 35*a*. Contact portions 35*b* extend upwards from the bridging portions 35*d*. The contact portions 35*b* each have resiliency and have at its free end an enlarged contact end, shown as chevron-shaped abutment portions 35*c* which are brought into contact with the contact portions 24*b* of the plug terminals 24. The receptacle terminals 35 are formed integrally through stamping of a conductive metal plate. The terminals have a general U-shape between this contact and support portions.

The bridging portions 35*d* of the receptacle terminals 35 are arranged along the bottom inner surface 33*a* of the bottom portion 33 of the receptacle housing 31. The bottom portion 33 of the receptacle housing 31 extends between the bridging portions 35*d* and the board 3.

In the middle of the support portions 35*a* of the receptacle terminals 35, there are provided linear anchor portions 36 extending substantially parallel to the contact portions 35*b* (or vertically as shown). On either side of the middle portions of the anchor portions 36 are recesses 36*b*, 36*b*. The receptacle housing 31 has fitting holes or openings 37 formed therein which extend through the housing to the opposite surface of the mating side end surface 32*d*. In the middle portions of the fitting holes 37, there are provided protrusions 37*a*, 37*a* that engage with the recesses 36*b*, 36*b* of the anchor portions 36. When the anchor portions 36 of the receptacle terminals 35 are press fit into the fitting holes 37, the recesses 36*b*, 36*b* of the anchor portions 36 lock with the protrusions 37*a*, 37*a* of the fitting holes 37. As a result, the receptacle terminals 35 are reliably fixed to the receptacle housing 31.

Solder portions 36*a* of the anchor portions 36 protrude outwardly beyond the surface 31*a* of the receptacle housing 31. The solder portions 36*a* of the anchor portions 36 protrude far enough beyond the surface 31*a* to enable them to be soldered to a circuit 38 on the board 3 when the connector 12 is placed on the board. Since this anchor portion is short in height it is rigid and will not bend during engagement and disengagement of the two connectors, thus forming a very good mechanical engagement with the board 3.

Next, the operation of the board connecting system 1 will be described with reference to FIG. 2. When electrically connecting the boards 2, 3 by the board connecting system 1, the support portions 24*a* of the plug terminals 24 of the plug connector 11 are soldered to the conductive circuit on one board 2. As a result, the plug connector 11 is fixed to the board 2. Further, the forward end portions 36*a* of the anchor portions 36 of the receptacle terminals 35 of the receptacle connector 12 are soldered to the conductive circuit 38 on the other board 3. As a result, the receptacle connector 12 is fixed to the board 3.

When an attempt is made to insert the plug connector 11 into the receptacle connector 12, the fit-engagement protrusions 23, 23 of the plug housing 21 are fitted into the fit-engagement recess 32*a* of the receptacle housing 31, and the connectors 11, 12 are then mated with each other. When the plug connector 11 and the receptacle connector 12 have been mated with each other, the abutment portions 35*c* of the contact portions 35*b* of the receptacle terminals 35 abut the contact portions 24*b* of the plug terminals 24. As a result, the plug terminals 24 and the receptacle terminals 35 are electrically connected to each other, and the boards 2, 3 are electrically connected to each other.

The bottom portion 33 of the receptacle housing 31 extends between the bridging portions 35*d* of the receptacle terminals 35 and the board 3. As a result, except for the solder portions 36*a* of the anchor portions 36, a substantial portion of the receptacle terminals 35 are not exposed along the surface 31*a* of the receptacle housing 31 adjacent to the board 3. Thus, the bridging portions 35*d* of the receptacle terminals 35 do not contact the circuit board 3, so that it is possible to provide a conductive circuit on the surface of the board 3 opposed to the bridging portions 35*d*. As a result, an improvement is achieved in terms of the degree of freedom for the circuit design on the board 3.

The end portions 36*a* of the linear anchor portions 36 of the receptacle terminals 35 protrude outwardly from the surface 31*a* of the receptacle housing 31 adjacent to the board 3, and are soldered to the circuit terminal 38 of the board 3. As a result, the receptacle connector 12 is fixed to the board 3. Thus, there is no need to provide the receptacle terminals 35 with solder tail portions extending as elongated arms beyond the outer frame portion of the connector housing, so that it is possible to achieve a reduction in the size of the receptacle terminals 35 and of the entire receptacle connector 12. Also the electrical length of the terminal is shortened which is important in high speed data transmission. To allow for the inspection of the solder joint under the housing 31 a cut out 39 is provided along the sides of the frame portions 32 near the board 3.

Figure 3:
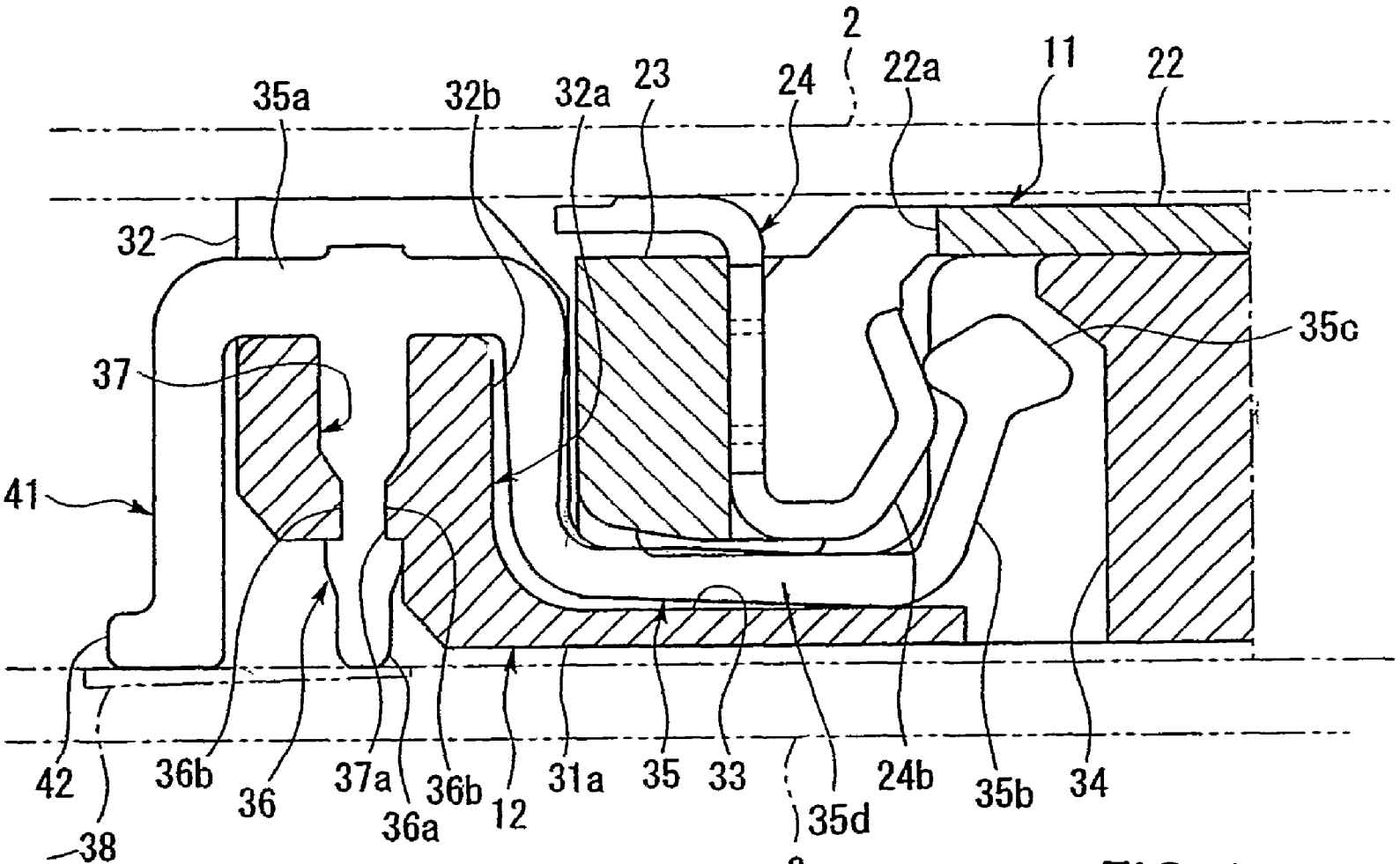

While in the above-described embodiment the receptacle terminals 35 are not provided with solder tail portions, it is also possible, as shown in FIG. 3, to form receptacle terminals with solder tail portions 41. In the following description, the portions that are the same as those of FIG. 1 are indicated by the same reference symbols, and a detailed description thereof will be omitted. Like the anchor portions 36, solder tail portions 41 are provided which extend from the end portions of the support portions 35*a* toward the board 3.

The solder tail portions 41 are formed in a substantially reverse-L-shaped configuration. Short side portions 42 at the forward ends of the solder tail portions 41 are soldered to the board 3. Further, the forward solder portions 36*a* of the anchor portions 36 are also soldered to the circuit terminal 38 of the board 3. Since both the solder tail portions 41 and the anchor portions 36 are soldered to the conductive circuit on the board 3, an improvement in the soldering strength is achieved.

While in the above-described embodiment the receptacle terminals 35 are mounted by press fitting them into the receptacle housing 31, it is also possible to mount the receptacle terminals 35 to the receptacle housing 31 by over-molding. In the case of manufacturing through over-molding, no recesses 36*b* are formed in the anchor portions 36, and no protrusions 37*a* are formed in the fitting holes 37. The portions of the receptacle housing 31 corresponding to the anchor portions 36 and the fitting holes 37 are formed such that their longitudinal sections are substantially in a straight line.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A board-mount connector comprising:

a non-conductive housing with a board mounting face, the non-conductive housing having an outer frame portion and fitting holes disposed therein, each fitting hole completely extending through the non-conductive housing, opening to the board mounting face, and including at least one protrusion extending from a side thereof; and a plurality of conductive terminals inserted into the non-conductive housing opposite the board mounting face, each conductive terminal having a support portion, a contact portion for contacting terminals of a mating connector, a bridging portion provided between the support portion and the contact portion, and an anchor portion extending from the support portion and fitted into a respective fitting hole;

wherein the anchor portion includes at least one recess and a solder portion extending, in the same direction as the anchor portion, out of the fitting hole a distance for contacting a circuit on a printed circuit board to which the board-mount connector is mounted.

2. The board-mount connector of claim 1, wherein the non-conductive housing further includes a bottom portion adjacent to the printed circuit board when mounted thereto.

3. The board-mount connector of claim 1, wherein each anchor portion is press fit into one of the fitting holes.

4. The board-mount connector of claim 1, wherein each solder portion is positioned in the non-conductive housing to contact the printed circuit board within an area bounded by the outer frame portion of the non-conductive housing, whereby no solder portion extends exterior of the outer frame portion of the non-conductive housing.

5. The board-mount connector of claim 1 wherein the non-conductive housing further includes cut out portions disposed along the bottom sides of the non-conductive housing, the cut out portions permitting inspection of solder joints formed at each solder portion.

6. The board-mount connector of claim 1 wherein each conductive terminal includes a solder tail portion, the solder tail portion extending from the terminal support portion to the printed circuit board alongside exterior surfaces of the non-conductive housing.

7. The board-mount connector of claim 1, wherein each protrusion is disposed within a middle portion of the fitting hole.

8. The board-mount connector of claim 7, wherein each recess is disposed within a middle portion of the anchor portion.

9. The board-mount connector of claim 8, wherein each protrusion fits within one recess to provide a reliable fit between each conductive terminal and the non-conductive housing.

10. A receptacle connector for mounting to a circuit board, comprising:

a housing, the housing including a plurality of exterior walls that cooperatively define the housing, a center projection disposed interior of the exterior walls, the center projection being surrounded by and spaced apart from the exterior walls by an intervening channel, the intervening channel receiving an opposing plug portion of a mating plug connector when the receptacle connector is mated to thereto, two of the exterior walls including a plurality of fitting holes spaced apart from each other, each fitting hole including at least one protrusion extending from a side thereof; and a plurality of conductive terminals supported by inserted into the housing, each conductive terminal including a support portion, an anchor portion and a contact portion, each support portion being supported by the exterior walls, each anchor portion terminating in a solder portion and including at least one recess and being received in one of the fitting holes each contact portion being spaced apart from the anchor portions such that each contact portion is disposed adjacent the center projection, and each solder portion extending through the exterior walls, in the same direction as the anchor portion, such that each solder portion is in opposition to the circuit board when the receptacle connector is mounted thereto.

11. The receptacle connector of claim 10, wherein the housing further includes cut out portions disposed along bottom edges of two of the exterior walls, the cut out portions being interposed between the two exterior walls and a mounting surface of the circuit board, each solder end portion extending through the exterior walls into the cut out portions for contacting the circuit board when the receptacle connector is mounted thereto.

12. The receptacle connector of claim 11, wherein the cut out portions permit visual inspection of solder joints between the solder portions and the circuit board when the receptacle connector is mounted thereto.

13. The receptacle connector of claim 10, wherein each conductive terminal includes a U-shaped connecting portion interconnecting the support and contact portions together.

14. The receptacle connector of claim 13, wherein free ends of each solder portion are disposed at a location below the U-shaped connecting portions.

15. The receptacle connector of claim 10, wherein each conductive terminal includes an additional solder portion in the form of a solder tail, extending away from the support portions exterior of the exterior walls, alongside the cut out portions.

* * * * *